US010539009B2

(12) United States Patent
Graf et al.

(10) Patent No.: US 10,539,009 B2
(45) Date of Patent: Jan. 21, 2020

(54) SHORT RANGE DATA TRANSMISSION IN A BOREHOLE

(75) Inventors: Stephan Graf, Paso Robles, CA (US); Matthew A. White, Templeton, CA (US)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 682 days.

(21) Appl. No.: 13/572,338

(22) Filed: Aug. 10, 2012

(65) Prior Publication Data

US 2013/0038332 A1 Feb. 14, 2013

Related U.S. Application Data

(60) Provisional application No. 61/522,046, filed on Aug. 10, 2011.

(51) Int. Cl.
*G01V 3/00* (2006.01)
*E21B 47/12* (2012.01)

(52) U.S. Cl.
CPC ..... *E21B 47/122* (2013.01)

(58) Field of Classification Search
CPC .. G01V 3/28; G01V 3/26; E21B 47/01; E21B 47/122
USPC ..... 324/342
See application file for complete search history.

(56) References Cited

U.S. PATENT DOCUMENTS 4,264,862 A * 4/1981 Koelle et al. ..... 324/339
5,160,925 A 11/1992 Dailey et al.
6,191,586 B1 * 2/2001 Bittar ..... G01V 3/28 324/338
6,215,304 B1 * 4/2001 Slade ..... 324/303
6,690,170 B2 * 2/2004 Homan ..... G01V 3/28 324/339
6,833,795 B1 * 12/2004 Johnson ..... G01V 3/12 166/255.1
7,239,145 B2 * 7/2007 Homan ..... G01V 3/30 324/347
7,518,528 B2 4/2009 Price et al.
2003/0071626 A1 * 4/2003 Omeragic ..... G01V 3/28 324/338
2004/0061622 A1 * 4/2004 Clark ..... G01V 3/28 340/854.6
2004/0119607 A1 * 6/2004 Davies ..... E21B 4/02 340/854.4
2005/0140373 A1 * 6/2005 Li et al. ..... 324/338
2005/0189945 A1 * 9/2005 Reiderman ..... G01V 3/28 324/333
2008/0030415 A1 * 2/2008 Homan ..... H01Q 1/04 343/719
2008/0211687 A1 * 9/2008 Price ..... E21B 17/028 340/854.3
2009/0058416 A1 * 3/2009 Blanz ..... G01N 24/081 324/303

(Continued)

*Primary Examiner* — Dominic E Hawkins
(74) *Attorney, Agent, or Firm* — Adolph Locklar

(57) ABSTRACT

The present disclosure is directed to an antenna for transfer of information along a drill string. The antenna has an antenna coil having a long side and short side. The antenna coil is adapted to be affixed to the drill string such that the long side of the antenna coil is along the longitudinal axis of the drill string, and the short side is perpendicular to the longitudinal axis of the drill string.

18 Claims, 5 Drawing Sheets

(56) References Cited

U.S. PATENT DOCUMENTS

| | | | | |
|---|---|---|---|---|
| 2009/0114807 | A1* | 5/2009 | Kirkwood | G01V 5/101 250/269.7 |
| 2009/0224764 | A1* | 9/2009 | Bittar | 324/338 |
| 2009/0295392 | A1* | 12/2009 | Feng | 324/333 |
| 2010/0039285 | A1* | 2/2010 | Vornbrock | G01V 11/002 340/854.4 |
| 2010/0097067 | A1* | 4/2010 | Synder, Jr. | G01V 3/28 324/339 |
| 2010/0117855 | A1* | 5/2010 | Sinclair | G01V 3/28 340/854.6 |
| 2010/0188080 | A1* | 7/2010 | Kruspe | G01V 3/32 324/303 |
| 2010/0305864 | A1* | 12/2010 | Gies | E21B 47/01 702/9 |
| 2011/0187373 | A1* | 8/2011 | Wisler | G01V 3/08 324/338 |
| 2013/0184995 | A1* | 7/2013 | Sinclair | G01V 99/00 702/9 |
| 2014/0060820 | A1* | 3/2014 | Bittar | E21B 47/01 166/250.01 |

* cited by examiner

SHORT RANGE DATA TRANSMISSION IN A BOREHOLE

CROSS-REFERENCE TO RELATED APPLICATIONS

This application claims priority from provisional application Ser. No. 61/522,046 filed Aug. 10, 2011.

BACKGROUND OF THE DISCLOSURE

Field

This disclosure relates to communication from downhole tools to the surface and among different sections of the bottom hole assembly (BHA).

Background Discussion

Directional drilling uses a BHA in the drill string, which typically includes a drill bit, stabilizers, bent subs, drill collars, rotary steerable and/or a turbine motor (mud motor) that is used to turn the drill bit. In addition to the BHA, a set of sensors and instrumentation, known as a measure while drilling system (MWD), is normally required to provide information to the driller that is necessary to guide and safely drill the borehole. Due to the mechanical complexity and the limited space in and around the BHA, the MWD is typically placed some distance from the bit above the motor assembly. A communication link to the surface is typically established by the MWD system using one or more means such as a wireline connection, mud pulse telemetry or electromagnetic wireless transmission. Because of the lag between the bit location and the sensors monitoring the progress of the drilling, the driller at the surface may not be immediately aware that the bit is deviating from the desired direction or that an unsafe condition has occurred. For this reason, drilling equipment providers have worked to provide a means of locating some or all of the sensors and instrumentation in the limited physical space in or below the motor assembly and therefore closer to the drill bit while maintaining the surface telemetry system above the motor assembly. These sensors generate near-bit data that is typically communicated to the MWD section to be transmitted to the surface.

SUMMARY

One embodiment of present disclosure is directed to an antenna for transfer of information along a drill string. The antenna has an antenna coil having a long side and short side. The antenna coil is adapted to be affixed to the drill string such that the long side of the antenna coil is along the longitudinal axis of the drill string, and the short side is perpendicular to the longitudinal axis of the drill string.

Another embodiment of the present disclosure is directed to a system for communication in a borehole. The system includes a first cross-coil antenna with an antenna coil having a long side and short side. The antenna coil is affixed to a drill string. The drill string includes a mud motor and a drill bit. The long side of the antenna coil is along the longitudinal axis of the drill string, and the short side is perpendicular to the longitudinal axis of the drill string. The system further includes an insulated gap electrode, toroidal antenna, a band electrode, or a second cross-coil antenna.

In still another embodiment, a method of borehole communication is disclosed. The method includes providing a first cross-coil antenna comprising an antenna coil having a long side and short side. The antenna coil is affixed to a drill string and the drill string includes a mud motor and a drill bit. The long side of the antenna coil is along the longitudinal axis of the drill string, and the short side is perpendicular to the longitudinal axis of the drill string. The method further includes providing a voltage source in electrical communication with the first cross-coil antenna and providing an insulated gap electrode, toroidal antenna, a band electrode, or a second cross-coil antenna. The method also includes actuating the voltage source to produce an electrical current in the first cross-coil antenna and inducing a magnetic field to form a current on the drill string. The current is used to transmit data along the drill string and the data is received at the insulated gap electrode, toroidal antenna, band electrode, or second cross-coil antenna.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily reduced for clarity of discussion.

DETAILED DESCRIPTION

Figure 1:
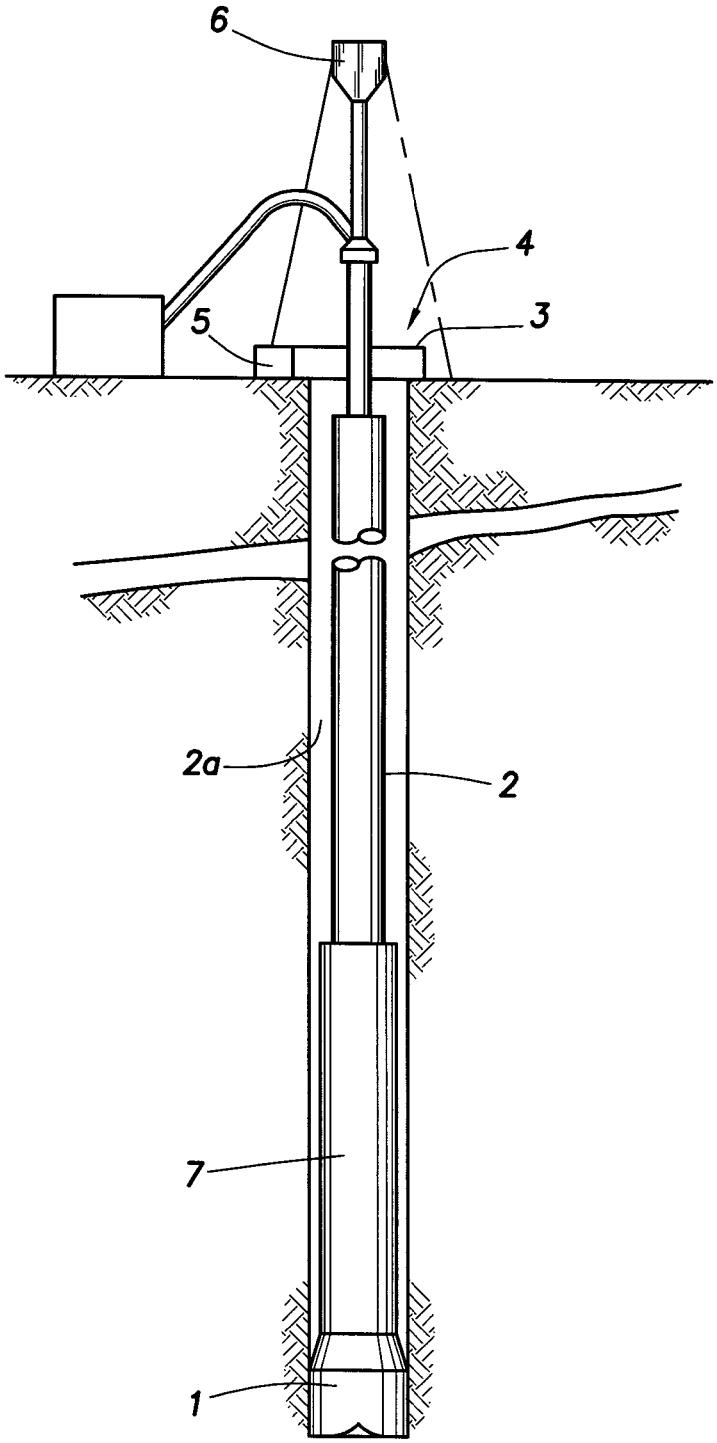
FIG. 1 is a depiction of a well installation consistent with certain embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 depicts diagrammatically a typical, non-limiting example of a rotary drilling installation of a type in which certain embodiments of the present disclosure may be used. The BHA includes drill bit 1 connected to the lower end of drill string 2 which is rotatably driven from the surface by rotary table 3 on drilling platform 4. A suitable drilling fluid, generally referred to as mud, may be pumped downward through the interior of drill string 2 to assist in drilling and to flush cuttings from the drilling operation back to the surface in annular space 2*a* outside of drill string 2. Rotary table 3 is driven by drive motor 5. Raising and lowering of drill string 2, and application of weight-on-bit, is under the control of draw works 6. Drill bit 1 may alternatively be rotated by a mud-motor, contained within apparatus 7, located in drill string 2.

Figure 2:
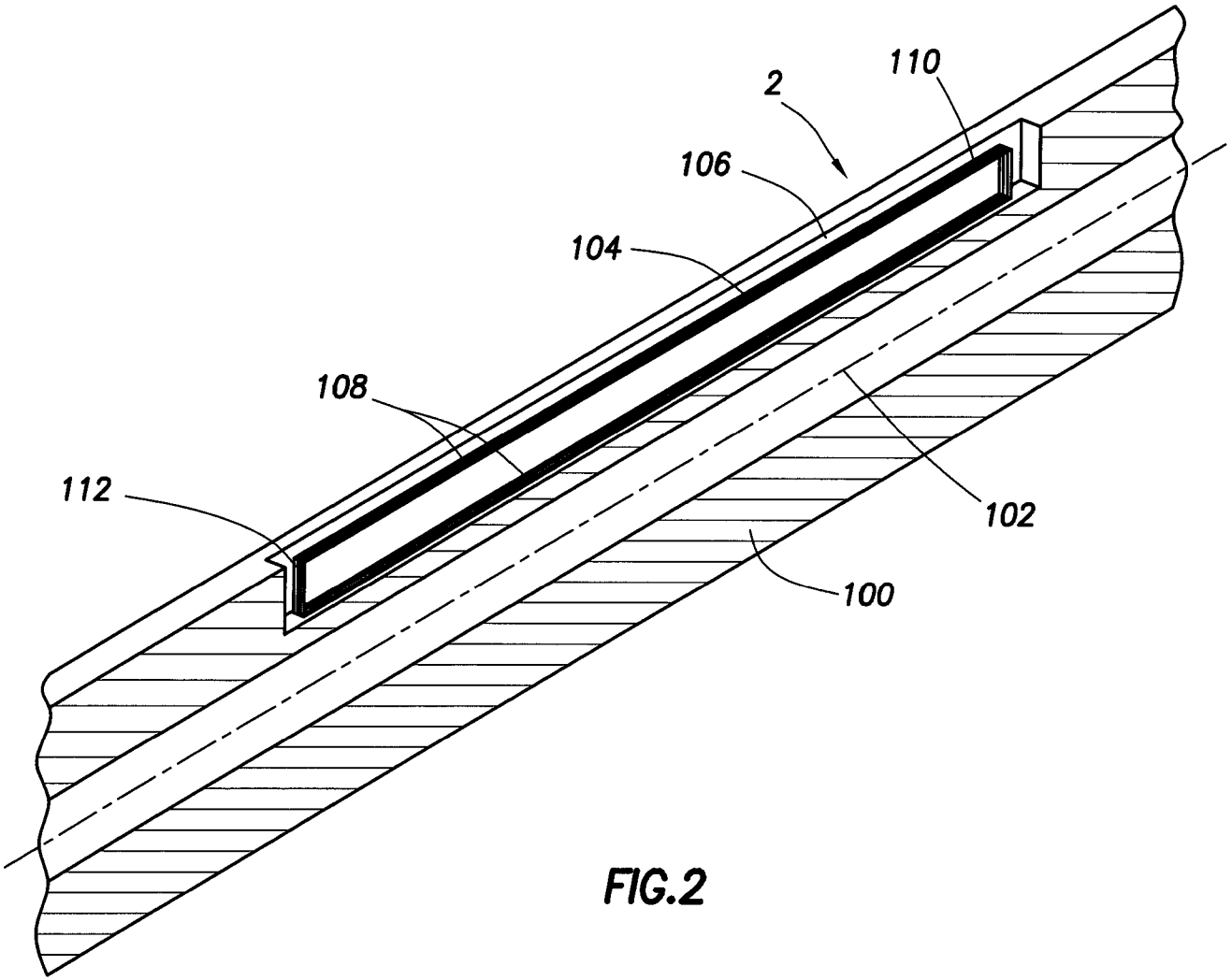
FIG. 2 is a depiction of a cross-coil antenna consistent with certain embodiments of the present disclosure.

FIG. 2 is a depiction of a cross-coil antenna consistent with certain embodiments of the present disclosure. A section of drill string 2 is shown with drill string collar 100. Drill string 2 has drill string axis 102. Cross-coil antenna 104 is shown within drill collar cutout 106.

Cross-coil antenna 104 as shown in FIG. 2 is rectangular, with cross-coil sides 110 being longer than cross-coil cross sides 112. Cross-coil antenna 104 may have multiple windings 108. The longer side of cross-coil windings 108 may run essentially parallel with drill string axis 102. The number of windings may be between 1 and 300, alternatively between 5 and 75, or between 10 and 40. In other embodiments of the present disclosure cross-coil antenna geometries can include, but are not limited to, circles, ovoids, squares, and other polygons. When cross-coil antenna 104 is rectangular, as depicted in FIG. 2, cross-coil sides 110 may be considerably longer than that of cross-coil cross sides 112. In certain non-limiting embodiments, the ratio of cross-coil side length to cross-coil cross side length can range from 1:1 to 1000:1 or from 10:1 to 100:1 or from 20:1 to 200:1. When the cross-coil side length exceeds that of the cross-coil cross side length, cross-coil antenna 104 is an elongated rectangle. The elongated rectangle form allows cross-coil antenna 104 to have a larger area while in place within drill collar cutout 106 than if the cross-coil side length 110 was less than or equal to that of cross-coil side length 112. Cross coil sides 110 may run essentially parallel with longitudinal drill string axis 102. Cross-coil sides 112 may be essentially perpendicular to coil sides 110. "Essentially perpendicular" allows orientation of the cross-coil sides 112 to be rotated about cross-coil side 110 by as much as about 50°.

In certain embodiments, cross-coil antenna 104 may have a ferrite or ferromagnetic core. When cross-coil antenna 104 has a ferrite or ferromagnetic core it may be desirable to cover the core with protective insulating material along the entire length of cross-coil antenna 104 in order to prevent the ingress of mud and water and to prevent mechanical damage. The type of insulating material is not critical and any suitable material may be used. In other embodiments, cross coil antenna may have an insulating material as a core. In those embodiments, the resistivity may be more than 10 Ohm m, 100 Ohm m, 1000 Ohm m or $10^{15}$ Ohm m. In still other embodiments, cross-coil antenna 104 may be formed entirely of an electrically insulating material.

Cross-coil antenna 104 is electrically connected to a voltage source (not shown) sufficient to impart a current to cross-coil antenna 104, generating a magnetic field. When an alternating voltage source is activated, cross-coil antenna 104 forms a magnetic field which is capable of inducing a current in drill string 2. In some embodiments, the frequency range of the excitation of cross-coil antenna 104 is from 10 Hz to 100 kHz or from 100 Hz to 10 kHz or from 400 Hz to 4 kHz. Without wishing to be bound by theory, an alternating magnetic field is created by an alternating current (AC) signal made to flow through an appropriate inductor, typically a coil of wire, mounted on or around the drill pipe, thereby creating a magnetic flux. The presence of a highly permeable material such as ferrite or ferromagnetic material has the effect of increasing the effective area of the inductor, and correspondingly increasing the magnetic flux. Lines of flux are thus concentrated by the ferrite or ferromagnetic material, which acts as a conduit for the alternating magnetic field.

Cross-coil antenna 104 is also capable of detecting an alternating current on drill string 2. An AC current on the drill string 2 creates an alternating magnetic field in cross-coil antenna 104 that induces a voltage across the cross-coil antenna 104 ends. In certain embodiments of the present disclosure, one end of the cross coil antenna 104 may be connected to the drill string or the sensor package.

Figure 3:
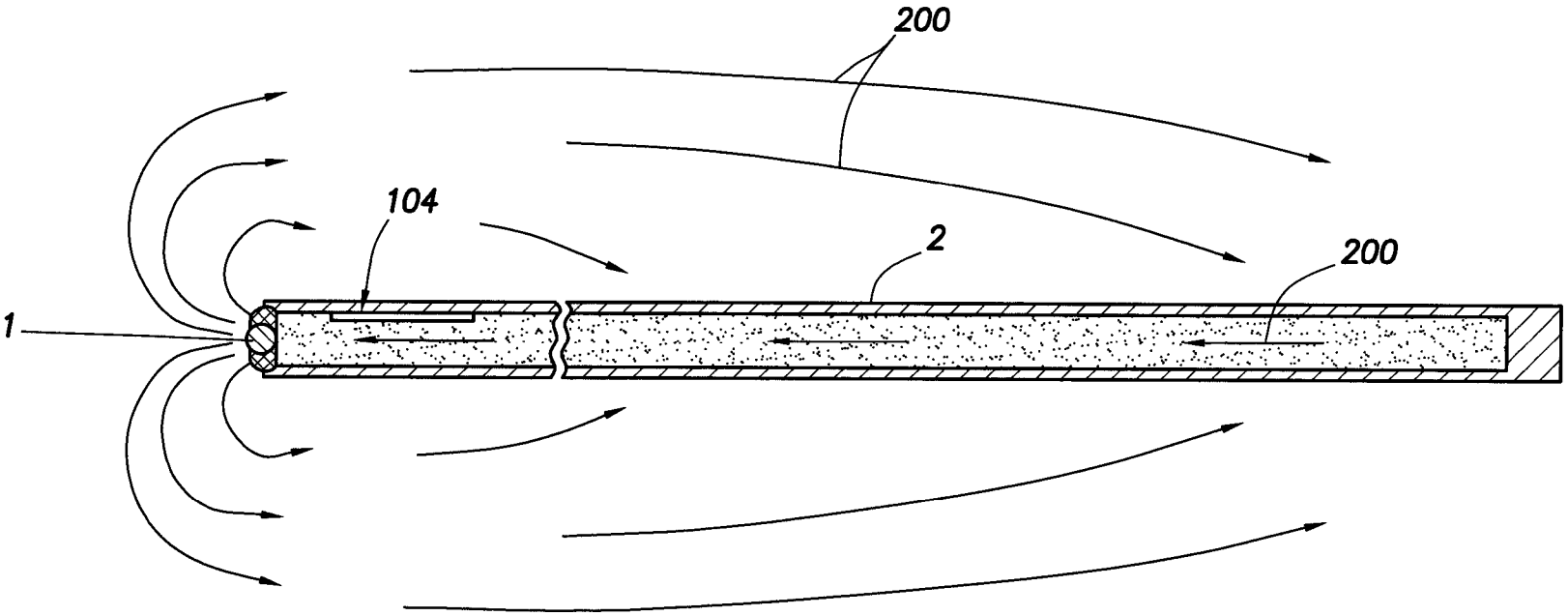
FIG. 3 depicts the electric current lines consistent with certain embodiments of the present disclosure.

FIG. 3 depicts the current flow lines 200 generated by certain embodiments of the present disclosure. When the voltage source is activated, cross-coil antenna 104 generates a magnetic field and thus is inducing a current through the drill string 2 and the formation.

Cross-coil antenna 104 may transmit signals to a gap electrode, a band electrode, a toroidal antenna, or to another cross-coil antenna. Examples of gap electrodes and band electrodes may be found in U.S. Pat. No. 7,518,528, which is fully incorporated herein by reference. An example of a toroid antenna may be found in U.S. Pat. No. 5,160,925, which is fully incorporated herein by reference.

Figure 4:
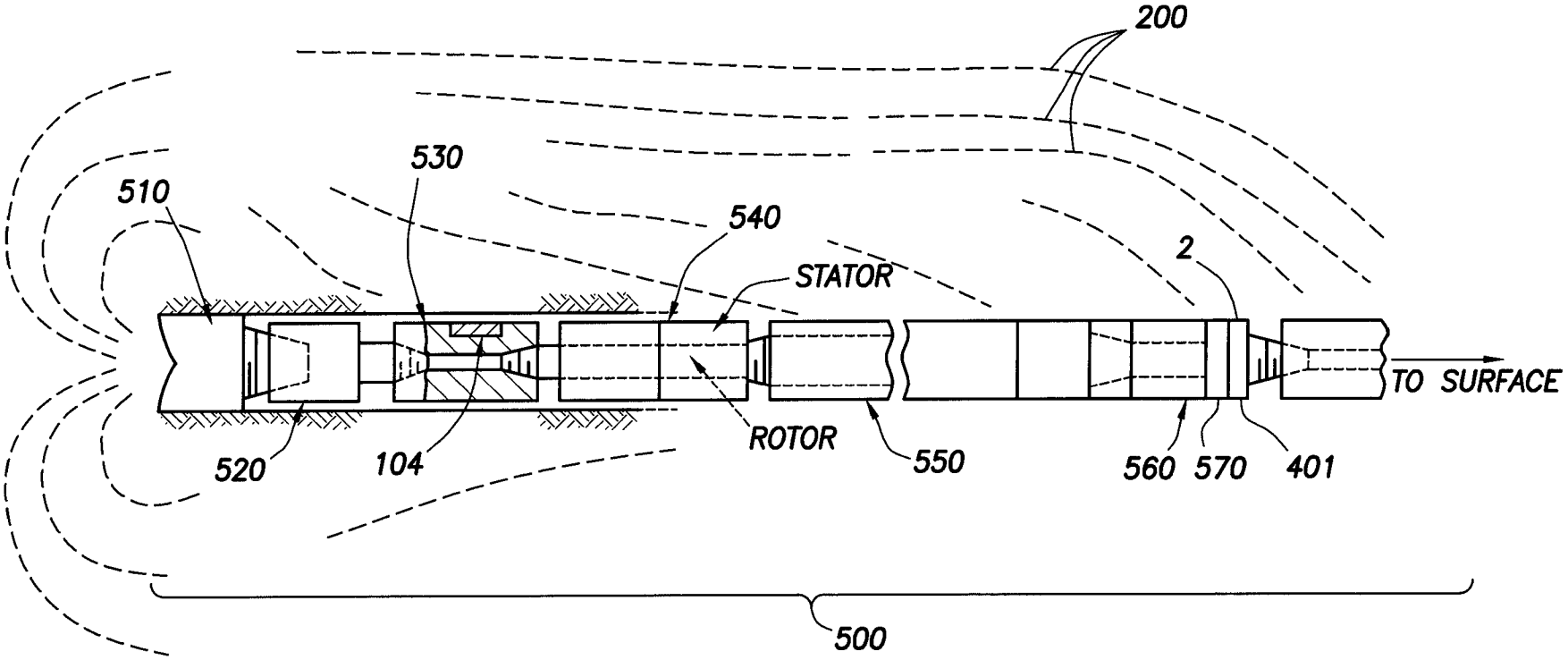
FIG. 4 depicts the placement of a cross-coil antenna consistent with certain embodiments of the present disclosure.

FIG. 4 depicts a particular embodiment of the present disclosure. Lower downhole assembly 500 includes drill bit 510, bit box 520, near-bit sub 530, mud motor 540, a string of subs and collars 550 that may include a mud pulser, an MWD sensor, and electric field transmitter to surface with its control subs 560 below an insulated gap electrode 570 in drill string 2.

Cross-coil antenna 104 is further depicted in FIG. 4 on near-bit sub 530 at a lower location below mud motor 540 or other mechanical means 550 and an insulating gap type electrode 570 on sub 401 above such a motor or mechanical means. In the embodiment depicted in FIG. 4, insulating gap electrode 570 can serve as both the upper electrical contact for the short hop communication link of one embodiment of the present disclosure and as the lower terminus of a surface link. In an alternative embodiment, surface communication link can be accomplished by mud pulse type. In this alternative embodiment, insulated gap electrode 570 may be accompanied by a mud pulser, not shown. The upper electrical contact for the short hop communication link could also be a toroidal antenna, a band electrode, or another cross-coil antenna.

In certain embodiments, in particular when oil-based-mud is in use, a cross-coil antenna may be used as a transmitter, with the receiver being a toroid antenna, insulating gap type electrode, or another cross-coil antenna.

Figure 5:
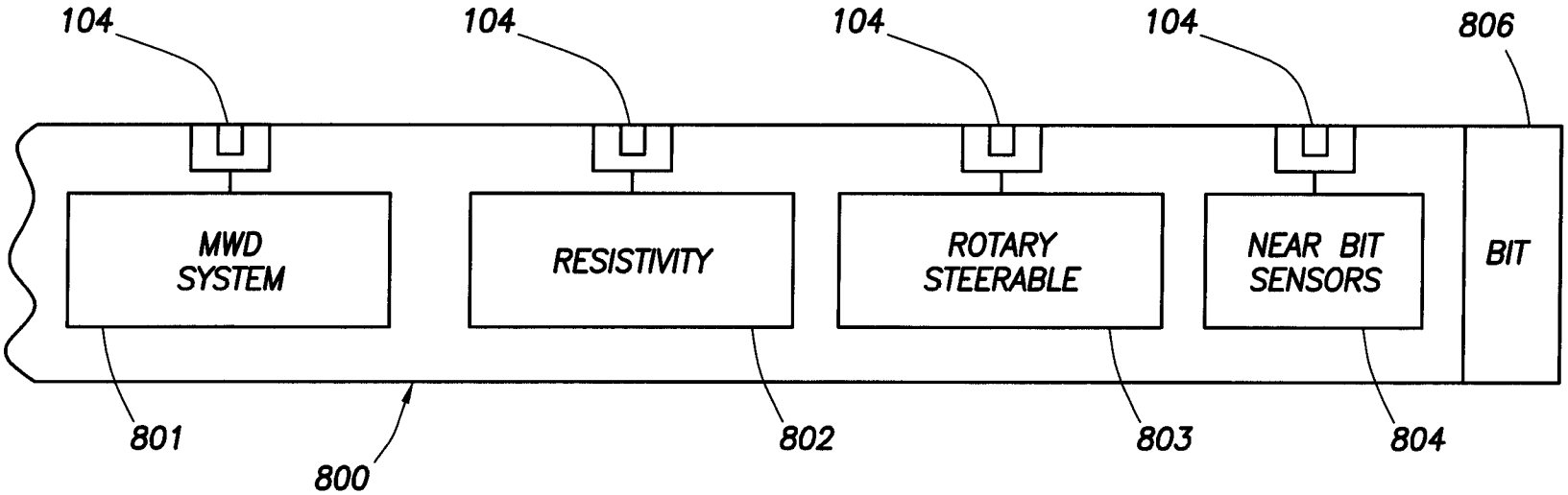
FIG. 5 depicts a multi-node bottom hole assembly communication consistent with certain embodiments of the present disclosure.

In another embodiment, a cross-coil antenna may be used as part of a multipoint communication network in the bottom hole assembly and drill string wherein a transceiver for each node in the system is utilized. FIG. 5 schematically shows one such multipoint communication network. Numeral 800 designates the bottom hole assembly of the drilling assembly. Mounted within this assembly as a sonde, or built integrally into the drill collars, are an MWD system 801 and a formation resistivity sensor 802. Numeral 803 depicts a rotary steerable device and 804 shows a near bit sensor, located just above the bit 806. Sensor 804 may include devices such as a natural gamma ray sensor, inclinometer or other sensors used in logging or geo steering of boreholes. Four uses of cross-coil antennas 104 are shown, Data communicated between these nodes can be used by the rotary steerable device 803 to adjust the course of the drilling or can be transmitted to the surface by the MWD system 801 for analysis by the directional driller. The invention in this case enables the wireless means for these independent sensors to share information and use that information to change events in the process of drilling a borehole. In other embodiments, one or more of the cross-coil antennas 104 may be replaced with a toroid antenna, insulating gap type electrode, or band electrode.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A method of borehole communication comprising:

providing a first cross-coil antenna comprising one or more windings arranged to form an antenna coil, each winding including a long side and short side, wherein the antenna coil is affixed to a drill string, wherein the drill string includes a mud motor and a drill bit, wherein the long side of each winding of the antenna coil comprises a plurality of segments wherein at least one of the plurality of segments is aligned essentially parallel with the longitudinal axis of the drill string, and wherein the short side of each winding comprises a plurality of segments wherein at least one of the plurality of segments is aligned essentially perpendicular to the longitudinal axis of the drill string and essentially perpendicular to the long side of the winding;

providing a voltage source in electrical communication with the first cross-coil antenna;

providing an insulated gap electrode, toroidal antenna, a band electrode, or a second cross-coil antenna;

actuating the voltage source to produce an electrical current in the first cross-coil antenna;

inducing a magnetic field to form a current on the drill string;

using the current to transmit data along the drill string; and receiving the data at the insulated gap electrode, toroidal antenna, band electrode, or second cross-coil antenna.

2. The method of claim 1, wherein the voltage source is an alternating current voltage source.

3. The method of claim 1 further comprising:

providing a mud-pulser, wherein the mud-pulser is in electrical communication with the insulated gap electrode, toroidal antenna, band electrode, or second cross-coil antenna;

communicating the data between the insulated gap electrode, toroidal antenna, band electrode, or second cross-coil antenna to the mud-pulser; and activating the mud-pulser to transmit the data uphole to a surface receiver.

4. The method of claim 1, wherein the first cross-coil antenna is located between the drill bit and the mud motor.

5. The method of claim 1, wherein the insulated gap electrode, toroidal antenna, band electrode, or second cross-coil antenna is located uphole from the mud motor and the first cross-coil antenna is located downhole from the mud motor.

6. The method of claim 1, wherein the first cross-coil antenna further comprises a core and the core is a ferrite or ferromagnetic material.

7. The method of claim 6, wherein the ferrite or ferromagnetic core is coated with an insulator.

8. The method of claim 1, wherein the first cross-coil antenna is comprised of an insulator.

9. The method of claim 1 further comprising:

transmitting data from the insulated gap electrode, toroidal antenna, band electrode, or second cross-coil antenna to the first cross-coil antenna using current; and receiving data at the first cross-coil antenna.

10. A method of borehole communication comprising:

providing a first cross-coil antenna comprising one or more windings arranged to form an antenna coil, each winding including a long side and a short side, wherein the antenna coil is affixed to a drill string, wherein the drill string includes a mud motor and a drill bit, wherein the long side of each winding of the antenna coil is aligned parallel with the axial longitudinal axis of the drill string, and wherein the short side of each winding extends radially outward from the axial longitudinal axis of the drill string and perpendicular to the long side of the winding;

providing a voltage source in electrical communication with the first cross-coil antenna;

providing an insulated gap electrode, toroidal antenna, a band electrode, or a second cross-coil antenna;

actuating the voltage source to produce an electrical current in the first cross-coil antenna;

inducing a magnetic field to form a current on the drill string;

using the current to transmit data along the drill string; and receiving the data at the insulated gap electrode, toroidal antenna, band electrode, or second cross-coil antenna.

11. The method of claim 10, wherein the voltage source is an alternating current voltage source.

12. The method of claim 10 further comprising:

providing a mud-pulser, wherein the mud-pulser is in electrical communication with the insulated gap electrode, toroidal antenna, band electrode, or second cross-coil antenna;

communicating the data between the insulated gap electrode, toroidal antenna, band electrode, or second cross-coil antenna to the mud-pulser; and activating the mud-pulser to transmit the data uphole to a surface receiver.

13. The method of claim 10, wherein the first cross-coil antenna is located between the drill bit and the mud motor.

14. The method of claim 10, wherein the insulated gap electrode, toroidal antenna, band electrode, or second cross-coil antenna is located uphole from the mud motor and the first cross-coil antenna is located downhole from the mud motor.

15. The method of claim 10, wherein the first cross-coil antenna further comprises a core and the core is a ferrite or ferromagnetic material.

16. The method of claim 15, wherein the ferrite or ferromagnetic core is coated with an insulator.

17. The method of claim 10, wherein the first cross-coil antenna is comprised of an insulator.

18. The method of claim 10 further comprising:

transmitting data from the insulated gap electrode, toroidal antenna, band electrode, or second cross-coil antenna to the first cross-coil antenna using current; and receiving data at the first cross-coil antenna.

* * * * *